US008800672B2

(12) United States Patent
Cerfeuillet et al.

(10) Patent No.: US 8,800,672 B2
(45) Date of Patent: Aug. 12, 2014

(54) PROPULSION DEVICE FOR AN AGENT CONTAINED IN A CAVITY

(75) Inventors: Vincent Cerfeuillet, St Gervais la Foret (FR); Patrick Fernandes, St. Aubin (FR)

(73) Assignee: Siemens S.A.S., Saint Denis (FR)

( * ) Notice: Subject to any disclaimer, the term of this patent is extended or adjusted under 35 U.S.C. 154(b) by 1133 days.

(21) Appl. No.: 11/899,587

(22) Filed: Sep. 6, 2007

(65) Prior Publication Data

US 2009/0133885 A1 May 28, 2009

(30) Foreign Application Priority Data

Sep. 21, 2006 (EP) ..... 06291491

(51) Int. Cl.

| | |
|---|---|
| ***A62C 35/00*** | (2006.01) |
| ***A62C 2/00*** | (2006.01) |
| ***A62C 25/00*** | (2006.01) |
| ***A62C 37/00*** | (2006.01) |
| ***A62C 37/50*** | (2006.01) |
| ***A62C 13/22*** | (2006.01) |
| ***A62C 35/58*** | (2006.01) |

(52) U.S. Cl.

USPC ..... 169/9; 169/11; 169/84; 169/85; 169/75; 169/46; 169/51; 169/56; 169/8

(58) Field of Classification Search

USPC ..... 169/9, 46, 11, 16, 62, 30, 5, 51, 17, 13, 169/14, 56, 28, 85, 84, 86, 87, 75, 71, 89, 169/36, 72, 6, 7, 8; 137/209

See application file for complete search history.

(56) References Cited

U.S. PATENT DOCUMENTS

| | | | | | |
|---|---|---|---|---|---|
| 183,604 | A | * | 10/1876 | Thompson | 422/226 |
| 802,821 | A | * | 10/1905 | Obenchain | 169/6 |
| 1,264,394 | A | * | 4/1918 | Hamilton | 169/8 |
| 1,397,411 | A | * | 11/1921 | Enright | 169/8 |
| 1,976,056 | A | * | 10/1934 | Wright | 169/87 |
| 1,976,074 | A | * | 10/1934 | Iddings et al. | 169/81 |
| 2,385,449 | A | | 9/1945 | Koehler | |
| 2,521,526 | A | * | 9/1950 | Mapes | 206/6 |
| 2,530,633 | A | * | 11/1950 | Scholz | 169/26 |
| 2,631,675 | A | * | 3/1953 | Orsini | 169/6 |
| 2,713,391 | A | * | 7/1955 | Buckholtz | 169/6 |
| 2,719,589 | A | * | 10/1955 | Mapes | 169/9 |

(Continued)

FOREIGN PATENT DOCUMENTS

WO 9423797 A1 10/1994

*Primary Examiner* — Len Tran
*Assistant Examiner* — Steven M Cernoch
(74) *Attorney, Agent, or Firm* — Laurence A. Greenberg; Werner H. Stemer; Ralph E. Locher

(57) ABSTRACT

A propulsion device for an agent, such as an extinguishing or cooling agent, contained in a cavity has at least a cap and a port configured to open above a calibrated pressure inside the cavity. A pressure generator is fastened to the cap and triggers the propulsion of the agent. The pressure generator has at least two containers, each having an exit ending inside the cavity and releasing a propulsion gas. At least one container is pressurized with an inert-type gas, such as helium, suited for minimal temperature fluctuations induced inside the cavity during a relief of pressure of the gas from at least one of the containers. When the gas expands it is the direct mechanical propellant of the agent.

22 Claims, 2 Drawing Sheets

(56) References Cited

U.S. PATENT DOCUMENTS

| | | | | | |
|---|---|---|---|---|---|
| 2,865,456 | A | * | 12/1958 | Dennis | 102/531 |
| 3,051,652 | A | * | 8/1962 | Olandt | 169/9 |
| 3,446,287 | A | * | 5/1969 | Hook | 169/28 |
| 3,492,944 | A | * | 2/1970 | White et al. | 102/367 |
| 3,614,987 | A | * | 10/1971 | Bonne | 169/60 |
| 3,977,474 | A | * | 8/1976 | Boegli | 169/9 |
| 4,197,213 | A | * | 4/1980 | Pietz et al. | 252/372 |
| 4,319,640 | A | * | 3/1982 | Brobeil | 169/28 |
| 4,487,266 | A | * | 12/1984 | Gillis et al. | 169/51 |
| 4,532,996 | A | * | 8/1985 | Wilson et al. | 169/23 |
| 4,779,683 | A | * | 10/1988 | Enk | 169/61 |
| 5,163,517 | A | * | 11/1992 | Kozai et al. | 169/60 |
| 5,385,208 | A | * | 1/1995 | Baker et al. | 169/46 |
| 5,458,202 | A | * | 10/1995 | Fellows et al. | 169/58 |
| 5,713,417 | A | * | 2/1998 | Sundholm | 169/46 |
| 5,845,714 | A | * | 12/1998 | Sundholm | 169/46 |
| 5,992,528 | A | * | 11/1999 | Parkinson et al. | 169/6 |
| 6,006,840 | A | * | 12/1999 | Sundholm | 169/9 |
| 6,053,256 | A | * | 4/2000 | Lu | 169/46 |
| 6,390,203 | B1 | * | 5/2002 | Borisov et al. | 169/62 |
| 6,702,033 | B1 | * | 3/2004 | Mitchell et al. | 169/85 |
| 8,083,003 | B2 | * | 12/2011 | Felten et al. | 169/73 |
| 2004/0216903 | A1 | * | 11/2004 | Wierenga et al. | 169/85 |
| 2005/0150665 | A1 | * | 7/2005 | Wierenga et al. | 169/85 |
| 2005/0257937 | A1 | * | 11/2005 | Fabre | 169/5 |
| 2007/0034387 | A1 | * | 2/2007 | Andersen et al. | 169/16 |
| 2009/0159300 | A1 | * | 6/2009 | Fabre | 169/9 |

* cited by examiner

PROPULSION DEVICE FOR AN AGENT CONTAINED IN A CAVITY

CROSS-REFERENCE TO RELATED APPLICATIONS

The present application claims priority under 35 U.S.C. §119 to European application no. 06291491.6, filed on Sep. 21, 2006, which is hereby incorporated by reference.

BACKGROUND OF THE INVENTION

The present invention relates to a propulsion device for an agent contained in a cavity.

In order to propel a gaseous or liquid agent, devices for propelling agents contained in cavities are known and include at least a cap for filling the cavity with the agent, and a port for the agent to leave the cavity. The cap is configured to open when a pressure in the cavity sealed with the cap exceeds a calibrated pressure. In order to open the port, for example, configured as a breakage or rupture disk in the wall of the cavity, a pressure generator can be fastened watertightly to the cap, and hence to the cavity. The pressure generator induces by electrical triggering the propulsion of the agent through the port that breaks under the build-up of pressure caused by the pressure generator.

Such devices find applications in several areas, for example, in the field of extinguishing fire or cooling, depending on whether the agent is an extinguisher or a cooling agent. However, they can be used in other distinct areas that require propulsion or a fast and eventually important thrust of an agent out of its storage cavity. In the following description, reference is made mainly to the area of extinguishing fire or cooling, especially in the field of transportation, e.g., by means of an aircraft where several problems concerning the propulsion device for an extinguisher agent can be faced, for example, regarding safety (impact resistance, making sure of the proper triggering of the pressure generator, etc.), limitation of the device volume, weight, cost, etc.

Furthermore, it is important to be explicit in two aspects relating to the making or maintenance of a gas generator that acts as an initiator of the propulsion of the agent out of the cavity. The first aspect is due to the fact that the gas generator can be damaged or simply does not work anymore for an undetermined reason. This aspect may escape a maintenance ground crew and disrupt the fire extinction in the flying aircraft. Therefore it is important to propose a propulsion device that is easy and efficiently to control.

The second aspect relates to the use of a pressure generator containing as principal initiator an energy-type fuel like an ordinary pyrotechnic module. This type of pyrotechnic generator, in addition to its good propulsion efficiency, requires a complex and expensive technique of manufacturing to ensure it is reliable enough, especially in aeronautics where standards of security are very strict. If the cavity needs to contain a large quantity of an extinguisher agent, a required quantity of energy material can then be equally high. This requires high skills of manufacturing and of maintenance to ensure the device operates with a proper level of safety and reliability.

SUMMARY OF THE INVENTION

One object of the present invention is to propose a high-safety device for the propulsion of a liquid or gaseous agent out of a cavity equipped with a pressure generator.

Accordingly, the invention proposes a propulsion device for a liquid or gaseous agent contained in a cavity having at least a cap and a port configured to open above a calibrated pressure inside the cavity. A pressure generator is fastened to the cap and configured to induce, e.g., by electrical triggering the propulsion of the agent.

A first advantageous aspect of the invention provides that the pressure generator comprises at least two containers, each having an exit ending inside the cavity (the exits could also end jointly inside the cavity). The two containers each release a propulsion gas which is used as a propellant to empty the cavity of its agent. Thus, if one of the containers presents a malfunction, the other container ensures at least propulsion of the agent out of the cavity. Indeed, this propulsion might be reduced, but ensures nevertheless a fire extinguishing. Advantageously, the reduction of propellant-type containers improves the safety, the modularity, the control of the required pressure profile, the installation flexibility, and the ease of maintenance of the propulsion device.

A second advantageous aspect of the invention is that at least one of the containers is pressurized (before using the device) with an inert-type gas that acts as a propellant gas and provides minimal fluctuations of temperature induced in the cavity during a relief of gas pressure from at least one of the containers towards the cavity. The expansion of the gas is the direct mechanical propellant of the agent through the outflow port. Preferably, the inert gas is the gaseous form of helium.

Other inert gases can be used. In this regard, it is noted that electrons of the last energy level (which corresponds to the last non empty electronic shell), or valence shell, are responsible for the chemical properties of the element. The last non-empty electronic shell of rare gases (helium, argon, krypton, xenon and radon) is complete. This is why these gases are called inert gases and are far from reactive. However, the heaviest rare gases like krypton, xenon and radon can participate in chemical reactions and the invention recommends avoiding them. Using helium as a propellant agent of the extinguishing agent then offers several advantages, among them:

- helium is lighter than air, which enables the design of a less heavy propulsion device;
- helium has a very low chemical reactivity;
- helium is non-flammable, which eliminates any possibility of an inopportune (or provoked) fire related to the pressure generator;
- helium can easily be held in a gaseous phase at temperatures above 4.2 K and, if needed, in a liquid phase below (at atmospheric pressure);
- helium has remarquable properties of superfluidity (sliding without frictions, low or even null viscosity in the cavity), which enables it to play its role as propellant of the extinguishing agent in an efficient way; and
- helium can adapt to rough climates (e.g., to temperatures below −40° C.) without causing a pressure disturbance at the exit of a container, which therefore is crucial to get the required pressure profile for the proper propulsion of the agent to be ejected out of the cavity. This would not be the case, if nitrogen was used instead of helium, because following differences of temperature nitrogen induces strong and impeding pressure variations.

Therefore, such a system avoids, or at least strongly minimizes the use of energy material (fuel) in the pressure generator. This is because the release of helium from the containers (in the following all the containers contain helium, unless otherwise stated) is triggered by electrical and then mechanical means or, at worst, by a pyrotechnic-type valve whose quantity of energy material is tiny (e.g., a few grams per container), namely with a minimal energy grade and solely sufficient to trigger the opening of one of the container exits to release the helium and cause the opening of the cavity outflow port.

Therefore, a use of the propulsion device for a liquid or gaseous agent is made possible, for which the introduction of energy-type combustible material should be minimum or even avoided since it imposes a complex technique to ensure a very good reliability, such as in the area of aeronautical, land, or ocean-going transport or in any flammable environment.

Moreover, taking into consideration the modularity of size/geometry of the containers or of their location with regard to the cavity (for example, inside the cavity itself, or outside the cavity via a duct to achieve the admission of the helium from a container towards the cavity), it is possible to install the device in an infrastructure which is of small size and/or imposes a distribution and/or a geometry of the cavity and of the containers specific to the infrastructure. This is particularly advantageous for locations where problems of space or of safety are occurring, such as in aircrafts or any other means of transportation, but also in buildings where space is scarce.

The containers containing helium can be pressurized cartridges, also called <<sparklets >>. These sparklets can be easily found on the market, as they are used for example for high-speed triggering of airbags used in vehicles. Further, these sparklets are less expensive and require simple maintenance compared to a pyrotechnic generator, for example. Moreover, they have a small size easing their installation inside or outside of the cavity.

In a preferred configuration where one of the containers containing helium, in addition to its sturdiness, would come to burst or to trigger itself inopportunely, the use of the propulsion device is nevertheless made safe because a confinement of the pressure generator having its helium containers inside the cavity sealed by the cap is ensured. It is contemplated that the cavity and the cap are making a closed set of such sturdiness that the burst or the opening of all the containers at the same time is allowed.

A process of control can be advantageously adapted for an efficient maintenance of the propulsion device. Thus, it is possible to provide the following features:

- a measurement control for measuring the level of agent in the cavity is provided by means of (or along) an axis fastened inside the cavity on which the containers can be fastened,
- a control of the emptying of the cavity is provided through a burst sensor for the breakage disk,
- various means for filling the agent, even helium in pressurized form, can be used. However, if a helium container were to present a malfunctioning it is interchangeable, or even switchable to another safety container.

BRIEF DESCRIPTION OF THE SEVERAL VIEWS OF THE DRAWINGS

The novel features and method steps characteristic of the invention are set out in the claims below. The invention itself, however, as well as other features and advantages thereof, are best understood by reference to the detailed description, which follows, when read in conjunction with the accompanying drawings, wherein:

DETAILED DESCRIPTION OF THE INVENTION

The various embodiments shown in the figures relate to a propulsion device for expelling an agent, such as FK5-5-1-12, out of a cavity. However, it is contemplated that any other liquid or/and gaseous substance, such as a cooling or extinguishing agent, may be expelled.

Figure 1:
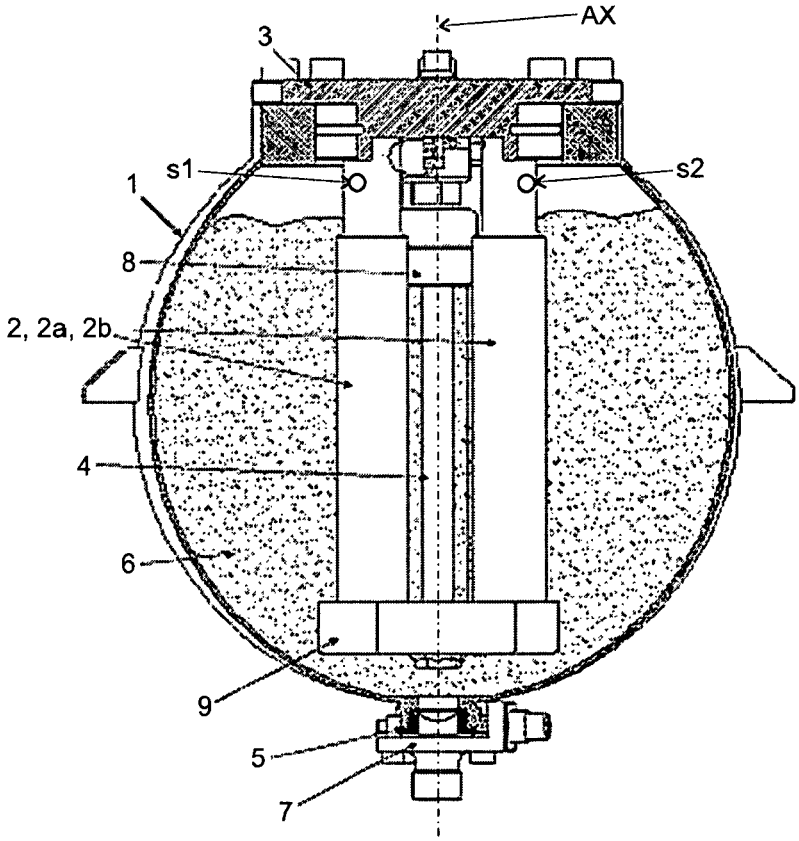
FIG. 1 shows one embodiment of a propulsion device.

FIG. 1 shows a propulsion device for expelling an extinguishing agent 6 according to the invention. In one embodiment, the propulsion device is installed aboard an aircraft for preventing a fire, for example, in an engine.

The propulsion device has a cavity 1 (e.g., a spherical cavity) containing the extinguishing agent 6, at least a cap 3 configured to be hermetically embedded/fastened in an upper opening of the cavity 1, and a port 5 (outflow port) configured to open under certain circumstances. In one embodiment, the port 5 includes a disk that breaks or ruptures when the pressure in the cavity 1 exceeds a pre-calibrated pressure. A pressure generator 2 is fastened to the cap 3 and configured to induce by electrical triggering the propulsion of the agent 6 via the port 5 (breakage disk) that is open. The pressure generator 2 has at least two containers 2*a*, 2*b*, each having an exit s1, s2 ending inside the cavity 1 and being pressurized with an inert-type gas (helium/He). The gas is suited for minimal temperature fluctuations induced inside the cavity 1 during the pressure relief of the gas (He) from at least one of the containers towards the cavity 1. When the gas (He) expands it is the direct mechanical propellant of the extinguishing agent 6 via the outflow port 5.

The pressure generator 2 comprises at least an opening module at the exits s1, s2 of the containers 2*a*, 2*b*. The opening module includes at least one pyrotechnic valve with an energy grade selected to be minimal but sufficient to trigger the opening of each of the exits s1, s2. Any other kind of opening module (e.g., mechanical, electrical) that allows to completely avoid the insertion of energy material is possible, of course. The containers 2*a*, 2*b* can also be triggered to relief pressure through distinct electrical triggerings and/or have a delayed triggering. They can also have dimensions and/or different gas (He) storage capacities. This allows generating pressure profiles inside the cavity or outputs of extinguishing agent 6 at the exit 7 of the cavity very well controlled because they are easily tunable/modulable in time or in intensity according to the capacity of each container.

In this example, the containers 2*a*, 2*b* are conventional cylindrical sparklets, disposed along a rotational axis in the spherical cavity 1 (materialized by an axial element AX). However, they can have a geometry and a disposition adapted to maximize the volume for retaining the agent 6 in the cavity 1.

At least one of the two containers 2*a*, 2*b* can be placed inside the cavity 1 by means of an upholding mounting 4 fastened preferably on the cap 3. However, FIG. 1 represents two containers (sparklets) 2*a*, 2*b* both of them held along the upholding mounting 4, which itself comprises the axial element AX fastened perpendicularly to the cap 3 and anchoring elements 9 of the containers 2*a*, 2*b* placed around the axial element (AX), here at the lower part of the cavity 1.

A measurement sensor 8 for measuring the level of filling of the extinguishing agent 6 in the cavity 1 is advantageously provided at a portion of the axial element AX. It can be realized thanks to a floating buoy (suited to float on the surface of the extinguishing agent 6) sliding along the axial element AX indicating the level of extinguishing agent 6 between the upper pole and the lower pole of the cavity 1. Other level indicator systems can be considered, of course.

One of the containers 2*a*, 2*b* can be used as a pressurized container of additional pressure (to allow modifying at will a thrust profile of the agent in time or in intensity), or as a safety container in case of a failure of the other container (or of the other possible containers).

It is also worth noting that at least one of the container 2*a*, 2*b* is, if necessary, easily interchangeable manually or automatically, in particular through a possible switching of its exit with the exit of the other container, or one of the other containers 2*a*, 2*b*. As an alternative, the containers can be designed to be refillable with pressurized gas (He). Similarly, the cavity 1 can comprise an inlet for filling the cavity 1 with the agent 6, for example, via the cap 3. Thus, safety and ease of maintenance are increased.

According to FIG. 1, the gas generator 2 comprises several containers 2*a*, 2*b* placed at least on one side of the cap 3, each container being of cylindrical shape with a rotational axis perpendicular to the cap 3 (therefore going along the axial element AX and fastened to the upholding mounting 4), wherein the total area of their cylindrical sections is smaller than the one of the cap 3. This way, the simple withdrawal or the simple closing of the cap 3 enables removing the set of the gas generator 2 with all its containers for example for various applications of maintenance which therefore are simplified or speeded up.

It is contemplated that the exits s1, s2 of the containers 2*a*, 2*b* or their endings inside the cavity 1 are placed in an interstice between the cap 3 and the extinguishing agent 6, for example, at the upper pole of the cavity 1, diametrally opposed to the breakage disk 5 of the cavity 1 where the agent will be ejected after its breaking. The interstice itself can comprise gas flux deflector means defl at the exits s1, s2 of the containers 2*a*, 2*b* in order to better target the required pressure zones for the propulsion of the extinguishing agent 6 out of the cavity 1.

Figure 2:
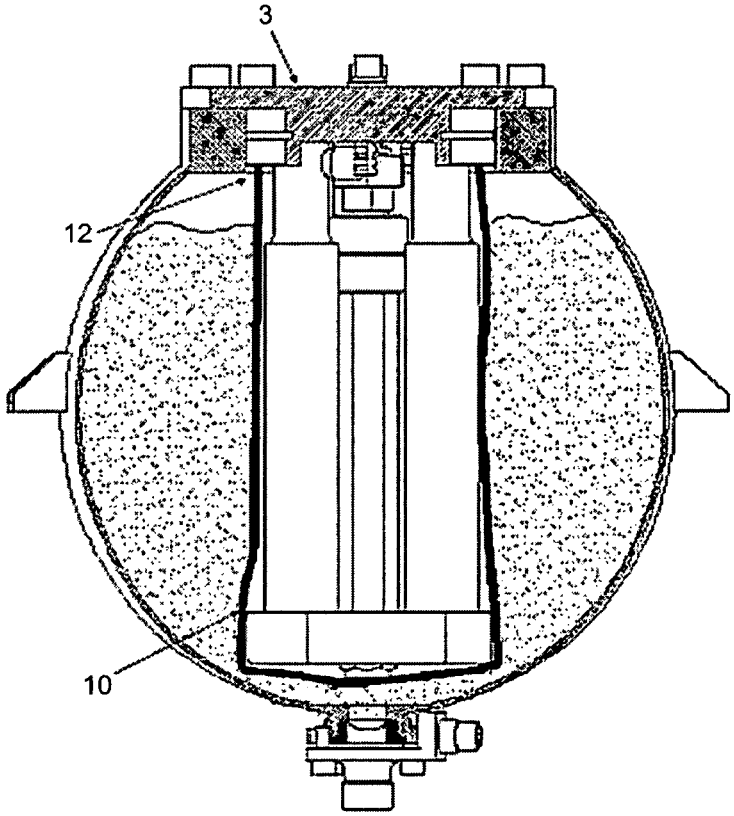
FIG. 2 shows one embodiment of a propulsion device having a deployment membrane.

FIG. 2 shows the propulsion device for the extinguishing agent 6 having at least one of the containers 2*a*, 2*b* in the cavity 1 placed inside a deployment membrane 10 with a closed surface, or a surface capable of being closed with the cap 3, for example, at its circumference 12 inside the cavity 1. This membrane 10 mainly enables a physical separation between the mechanical propellant (helium coming from one or the containers 2*a*, 2*b*) and the extinguishing agent 6 to be ejected out of the cavity 1. Given that helium or any other inert gas have chemical properties far from reactive or thermally stable, the membrane 10 can be made of a material which depends only on the chemical properties of the extinguishing agent 6. Thus, the membrane 10 is free of any requirement of being fireproof or having a resistance to strong rises in temperature, as known from using a pyrotechnic generator releasing a high temperature gas. Advantageously, this simplifies the design and reduces the cost of the membrane 10.

The deployed membrane 10 can also be designed to burst at the end of the ejection of the extinguishing agent 6, after which a purging of the cavity 1 or of posterior ducts 7 can take place. This can be done by means of a cutting element that breaks/opens the openable port 5 of the cavity 1. The deployment membrane 10 is in the present case kept away from the openable port 5 by means of at least one point of fastening of the deployment membrane 10 placed at a tolerated distance from the breakage port 5, which enables to prevent an inopportune sealing of the openable port or of the exit duct 7 with the membrane or membrane parts. Thanks to the disposition according to FIG. 2, the set with the interlocked elements <<cap, containers, membrane>> is still easily removable from the rest of the cavity 1, for example, by unscrewing only the cap 3 of the cavity 1.

Figure 3:
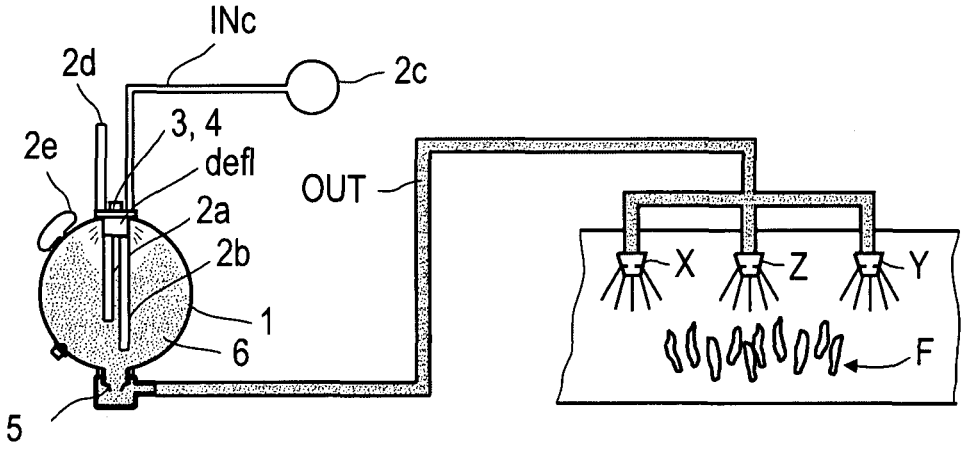
FIG. 3 shows a complete and modular system including a propulsion device.

FIG. 3 demonstrates, among other things, the high modularity and adaptability of the propulsion device according to the invention. The device is shown schematically (cavity 1, extinguishing agent 6, port 5), wherein for extinguishing a fire F ejection nozzles X, Y, Z are connected to the port 5 (exit) of the cavity 1. In FIGS. 1 and 2, two helium containers 2*a*, 2*b* are placed jointly with the cap (through an upholding mounting 4) inside the cavity 1. In the illustrated example, the containers 2*a*, 2*b* do not have the same size (and therefore store different quantities of helium) and can at will be triggered at various moments according to a required pressure profile.

In the embodiment of FIG. 3, it is an object to minimize the device geometry, for example, due to lack of space, to install it in an aircraft. Thanks to the reduction of the helium containers, at least one of the other containers 2*c*, 2*d*, 2*e* is indeed placed out of the cavity 1 and may be, if possible, fastened on the upholding mounting 4 by the cap 3 (containers 2*c*, 2*d*) or directly on the cavity 1 (container 2*e*). Advantageously, this modularity of containers locations enables reducing the size of the cavity 1 containing the extinguishing agent 6 or to fill up the cavity 1 with more extinguishing agent 6 if necessary. Thus, the device of the present invention can be appropriately installed in an environment basically restrained or with a complex infrastructure.

Furthermore, if the space problem were of more concern, or if the containers had to be away from the cavity or concealed such as for safety reasons, it is also possible to connect an external container spaced apart from cavity 1 to the cavity 1 via an incoming duct INc ending inside the cavity 1 via the cap 3, for example. All these aspects allow using the device in a system adaptable to a lot of different situations and reconfigurable according to the requirements or the modifications of its environment. In the same way as in FIGS. 1 and 2, some containers can be used for providing additional pressure or additional safety with respect to other containers.

Of course, the propulsion device with several helium containers may be combined with a propulsion device having a pressure generator of a pyrotechnic generator type. For example, the helium containers can play the role of an additional pressure generator for a pyrotechnic gas generator when the properties or the conditions of the extinguisher device are to be readapted. In sum, the containers 2*a*, 2*b* can be easily used as substitutes or complements of a conventional hot gas generator, such as a pyrotechnic generator, in particular in the area of aeronautical, land, ocean-going transports or in a flammable environment.

What is claimed is:

1. A device for propelling an agent, comprising:

a cavity configured to contain the agent;

a cap mounted to the cavity;

a port configured to open above a calibrated pressure inside the cavity; and a pressure generator coupled to the cap and configured to trigger propelling the agent from the cavity, wherein the pressure generator comprises at least two containers, and each one of the containers has an exit ending inside the cavity, wherein a first one of the containers is a pressurized container that stores a first propulsion gas that acts on the agent when released and a second one of the containers is a pressurized container that stores a second propulsion gas that acts on the agent when released, and wherein at least one of the first and second gas is an inert gas that is selected to have minimal temperature fluctuations induced in the cavity during a pressure relief of the inert gas from at least one of the containers, wherein the inert gas in expansion is the direct propellant of the agent;

wherein at least one of the two containers is placed in the cavity by an upholding mounting fastened on the cap.

2. The device according to claim 1, wherein the inert gas is helium (He) in gaseous form.

3. The device according to claim 1, wherein the pressure generator comprises at least an opening module at the exits of the containers, wherein the opening module comprises at least one pyrotechnic valve with a minimal energy grade and sufficient to trigger the opening of one of the exits.

4. The device according to claim 1, wherein the containers are configured to be triggered to expansion by at least one of distinct electrical triggering and delayed triggering.

5. The device according to claim 1, wherein the containers have a geometry and a disposition suited to maximize filling the cavity with the agent.

6. The device according to claim 1, wherein the containers have at least one of different dimensions and gas storage capacities.

7. The device according to claim 1, wherein at least one of the containers is placed outside the cavity, fastened on an upholding mounting on one of the cap and the cavity, and configured to connect to the cavity via an incoming duct.

8. The device according to claim 1, wherein the upholding mounting comprises an axial element fastened perpendicularly to the cap, and wherein anchoring elements of the containers are placed around the axial element.

9. The device according to claim 8, wherein a measurement sensor for measuring a filling level of the cavity with the agent, and wherein the measurement sensor is incorporated on a portion of the axial element.

10. The device according to claim 1, wherein one of the containers is one of a pressurized container of additional pressure and a safety container in case of failure of one of the other containers.

11. The device according to claim 1, wherein at least one of the containers is interchangeable by switching its exit with the exit of another of the containers.

12. The device according to claim 1, wherein the cavity comprises an inlet configured to fill the agent into the cavity.

13. The device according to claim 1, wherein exits of the containers are placed in an interstice between the cap and the agent.

14. The device according to claim 13, wherein the interstice comprises gas flux deflector means at the exits of the containers.

15. The device according to claim 1, wherein the port is a breakage element configured to break at a pre-calibrated pressure.

16. The device according to claim 1, wherein at least one of the containers in the cavity is placed in a deployment membrane.

17. The device according to claim 16, wherein the deployment membrane is kept away from the port by means of at least one point of fastening of the deployment membrane placed at a distance from the port.

18. The device according to claim 1, wherein the gas generator comprises several containers placed at least on one side of the cap, each container being of cylindrical shape with a rotational axis perpendicular to the cap, and wherein a total area of their cylindrical sections is smaller than the one of the cap.

19. The device according to claim 1, wherein the agent is one of an extinguishing agent and a cooling agent.

20. The device according to claim 1, wherein the first one of the containers releases the first propulsion gas when the first one of the containers is electrically triggered, and the second one of the containers releases the second propulsion gas when the second one of the containers is electrically triggered.

21. The device according to claim 1, wherein the exit of each one of the containers directly communicates with the cavity.

22. The device according to claim 1, wherein the one of the two containers is removeably placed in the cavity by the upholding mounting fastened on the cap.

* * * * *